US006386477B1

(12) United States Patent
Kaufmann et al.

(10) Patent No.: US 6,386,477 B1
(45) **Date of Patent: *May 14, 2002**

(54) STATION FOR CONTINUOUS UNWINDING OF A MATERIAL WEB

(75) Inventors: Bernd Kaufmann, Heidenheim; Johann Grupp, Oberkochen, both of (DE)

(73) Assignee: Voith Sulzer Papiermaschinen GmbH, Heidenheim (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/085,433

(22) Filed: May 27, 1998

(30) Foreign Application Priority Data

May 27, 1997 (DE) ..... 197 22 209

(51) Int. Cl.[7] ..... B65H 19/18

(52) U.S. Cl. ..... 242/555.3; 242/555.4; 242/556; 242/559.3; 242/564

(58) Field of Search ..... 242/555.3, 555.4, 242/556, 564, 559, 559.3, 561

(56) References Cited

U.S. PATENT DOCUMENTS

| | | | | |
|---|---|---|---|---|
| 2,775,409 A | | 12/1956 | Pomper | 242/58 |
| 3,032,289 A | * | 5/1962 | Fredriksson et al. | 242/559 |
| 4,165,842 A | * | 8/1979 | Mengel | 242/555.3 |
| 4,564,150 A | | 1/1986 | Keene et al. | 242/58.1 |
| 4,708,300 A | * | 11/1987 | Goetz | 242/559 |
| 4,729,522 A | | 3/1988 | Tafel et al. | 242/75.1 |

FOREIGN PATENT DOCUMENTS

| | | |
|---|---|---|
| DE | 1 046 471 | 10/1958 |
| DE | 1 250 709 | 9/1967 |
| DE | 1 574 632 | 2/1971 |
| DE | 29 02 480 | 7/1979 |
| DE | 2 118 984 | 11/1992 |
| GB | 2 018 727 A | 10/1979 |

* cited by examiner

*Primary Examiner*—John Q. Nguyen
(74) *Attorney, Agent, or Firm*—Taylor & Aust, P.C.

(57) ABSTRACT

An unwinding station continuously unwinds a material web, notably a paper or cardboard web, for a machine, specifically a coater, for conversion of the material web. The station includes a primary unwinding system, a secondary unwinding system and a splicing system to splice together material webs unwinding from two reels, with each reel being carried by one of the unwinding systems. The reel carried by the primary unwinding system, which is disposed after the splicing of the material webs to one another, is transferable by use of a carrying system to the secondary unwinding system. The unwinding station is distinguished specifically by an auxiliary drive that is movable jointly with the reel and which can be driven with the aid of the reel.

13 Claims, 4 Drawing Sheets

STATION FOR CONTINUOUS UNWINDING OF A MATERIAL WEB

BACKGROUND OF THE INVENTION

1. Field of the invention

The invention relates to a station for continuous unwinding of a material web, notably a paper or cardboard web.

2. Description of the related art

Unwinding stations for continuous unwinding of a material web are previously known. They serve the continuous unwinding of a material web from a reel and precede a machine for converting the material web, for example, a coater. A known unwinding station includes a primary and a secondary unwinding system serving to carry a reel. A full reel, to begin with, is carried by the primary unwinding system while the material web unwinds. Once the reel has reached a desired diameter, it is transferred from the primary to the secondary unwinding system. Employed for that purpose are pivoting arms which pivot about an axle and engage the reel on its two ends, transferring it in a pivotal movement to the secondary unwinding system. Next, the primary unwinding system receives a new, full reel, and the material web wound on it is spliced to the material web unwinding from the reel carried by the secondary unwinding system before it is unwound entirely. Provided for that purpose is a splicing system featuring a splicing roll that pivots about an axle and carries the material web unwinding from the reel to the material web converting machine. The reel is carried by the secondary unwinding system. To splice the two material webs together, the splicing roll pivots to press onto the reel carried by the primary unwinding system. Simultaneously with it, the material web which is unwinding from the reel carried by the secondary unwinding system is separated by use of a cutting device.

The known unwinding station has the disadvantage of having to exert, due to the heavy weight of the reel, very large forces in order to pivot this load in the transfer from the primary to the secondary unwinding system. The weight of the reel may amount to up to 40 tons. Required therefor are several separate hydraulic cylinders which pivot the arms, and which are very expensive and rugged in design. A further drawback is that the dimensions of the unwinding station, i.e., its vertical and longitudinal expanse, are relatively large on account of the great space needs of the pivoting construction, which serves to transfer the reel or position the splicing system. The costs of the unwinding station are high, specifically due to the pivoting constructions.

SUMMARY OF THE INVENTION

The present invention provides an unwinding station which features a simple and compact structure and allows a reliable use.

An unwinding station is distinguished by an auxiliary drive with the aid of which a torque can be exerted onto the reel while it transfers from the primary to the secondary unwinding system. Moving jointly with the reel, the auxiliary drive makes it possible to hold or adjust the unwinding traction of the material web unwinding from the reel to a desired value, notably during the transfer of the reel. As a result, the splice between the two material webs can be passed safely through the converting machine following the unwinding station.

An advantage of the present invention is that the reel can be moved along a first straight line which extends parallel to an imaginary horizontal line. An expensive pivoting construction and the hydraulic cylinders producing the pivotal movement, such as used with the known unwinding station, are thus dispensable, allowing a simplification of the structure of the unwinding station and a reduction of its overall height and/or length. Additionally, it is possible to also use the auxiliary drive while the reel is carried by the primary or the secondary unwinding system. Hence, the primary and the secondary unwinding systems are arranged at an equal level, i.e., at a same height, allowing a transfer of the reel with relatively low forces. The horizontal arrangement of the unwinding station makes it possible to simplify the design of the carrying system.

The splicing system features at least one splicing roll which, by use of a linear guide system, can be moved along a second straight line. This design allows simplifying the structure of the unwinding station. Furthermore, little space is needed for the linear guide system, which makes it possible to reduce both the length and height of the unwinding station.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

The unwinding station described hereinafter is suited for use generally in conjunction with a machine for converting or processing a material web, e.g., a coater, calender, rotary slitter or the like. Therefore, the following speaks quite generally of having the unwinding station coordinated with a paper web converting machine.

DETAILED DESCRIPTION OF THE INVENTION

Figure 1:
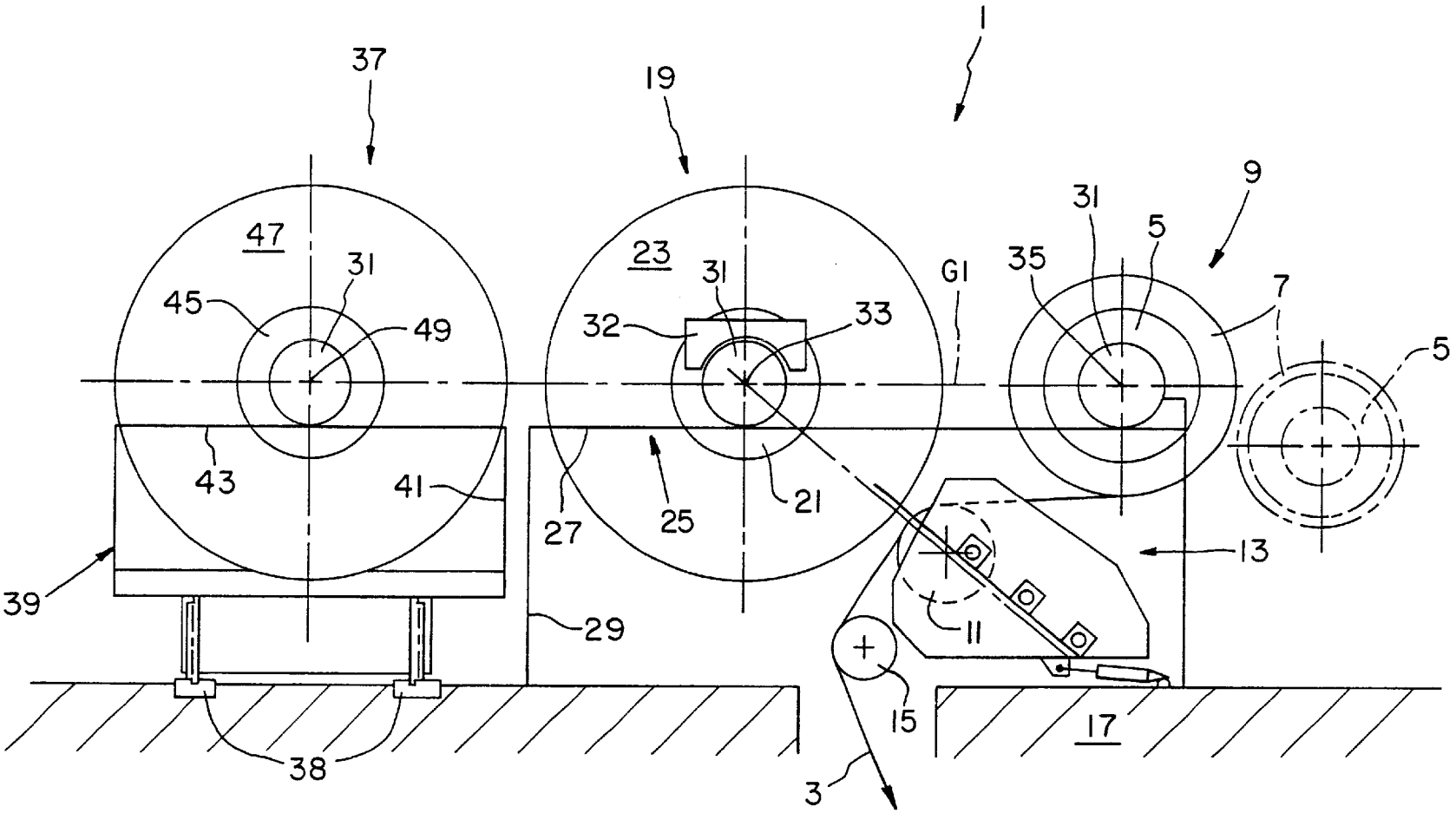
FIG. 1 is a schematic, side elevation of an embodiment of an unwinding station.

FIG. 1, greatly schematized, shows a side elevation of an unwinding station 1 serving the continuous unwinding of a paper web described hereinafter generally as material web 3. In the unwinding station 1, material webs wound on drums into reels are spliced to one another, i.e., made endless. This splicing enables a continuous converting operation in a converting machine (not shown) which follows the unwinding station in the direction of travel of the material web. In the operating position of the unwinding station 1 as illustrated in FIG. 1, the material web 3 unwinds from a reel 7 wound on a drum 5. Reel 7 is also described as secondary reel and is carried by a secondary unwinding system 9 not illustrated in detail. The material web 3 is carried over a splicing roll 11 of a splicing system 13 and via stationary guide roll 15 through an opening in a foundation 17 to a basement not illustrated in detail. The material web 3 transfers from the basement to the converting machine. Another embodiment provides for not passing the material web 3 into the basement, but directly from the guide roll 15 to the converting machine. Hence, the material web 3 may also be passed to the converting machine above the foundation 17. The unwinding station 1, moreover, includes a primary unwinding system 19, whose structure matches that of the secondary unwinding system 9. A primary reel 23 wound on a drum 21 is carried by the primary unwinding system 19. The structure of the unwinding systems is addressed in more detail with the aid of FIGS. 3 and 4.

The primary unwinding system 19 and the secondary unwinding system 9 are connected with each other by way of a carrying system 25 including two rails which extend parallel to each other. In the side elevation of the unwinding station 1 only the rail 27 is visible. The carrying system 25 is arranged on a frame 29 mounted on the foundation 17. Provided on their ends with journals 31, the drums 5, 21 are carried on the rails of the carrying system 25 by secondary carriages. In FIG. 1, only the carriage 32 is illustrated schematically. The carriages are driven by spindles (not shown), with the aid of which a precise positioning of the carriages, and thus the reel, is possible.

As can be seen from FIG. 1, the centers 33 and 35 of the reels 23, 7 are disposed on an imaginary first straight line G1, illustrated by dash-dot line, which extends parallel to an imaginary horizontal line, i.e., of level alignment. The function of unwinding station 1 will be more fully explained with the aid of FIG. 2.

New, i.e., full reels are supplied to the unwinding station 1 by use of a feed system 37 including a transport carriage 39 movable on rails 38 installed on the foundation 17. The rails 38 extend in the pictorial plane of FIG. 1, i.e., the transport carriage 39 is movable transverse to the longitudinal expanse of the unwinding station 1. The transport carriage 39 has as base frame 41 on which support rails 43 are mounted. Journals 31 of a drum 45 rest on support rails 43. Wound on the drum 45 is a reel 47, which may have a diameter of, e.g., 3,500 mm or more. Naturally, the diameter of the reel 47 may also be less than 3,500 mm. The support rails 43 of the transport carriage 39 are disposed at the same level as the rails 27 of the carrying system 25 so that the center 49 of the reel 47 is also disposed on the first straight line GI. Deriving thereof, in particular, is the advantage that a reel passed by use of the feed system 37 to the unwinding station 1 merely needs to roll over the support rails 43 of transport carriage 39 in order to transfer onto the rails 27 of the carrying system 25. To begin with, however, the reel 23 carried by the primary unwinding system 19 needs to be transferred to the secondary unwinding system 9, addressed in more detail hereinafter. The removal of an unwound reel from the unwinding station 1 can be effected by use of a lifting device (not shown). FIG. 1 illustrates the unwound reel 7 by dash-dot line in a position outside the unwinding station 1.

Figure 2:
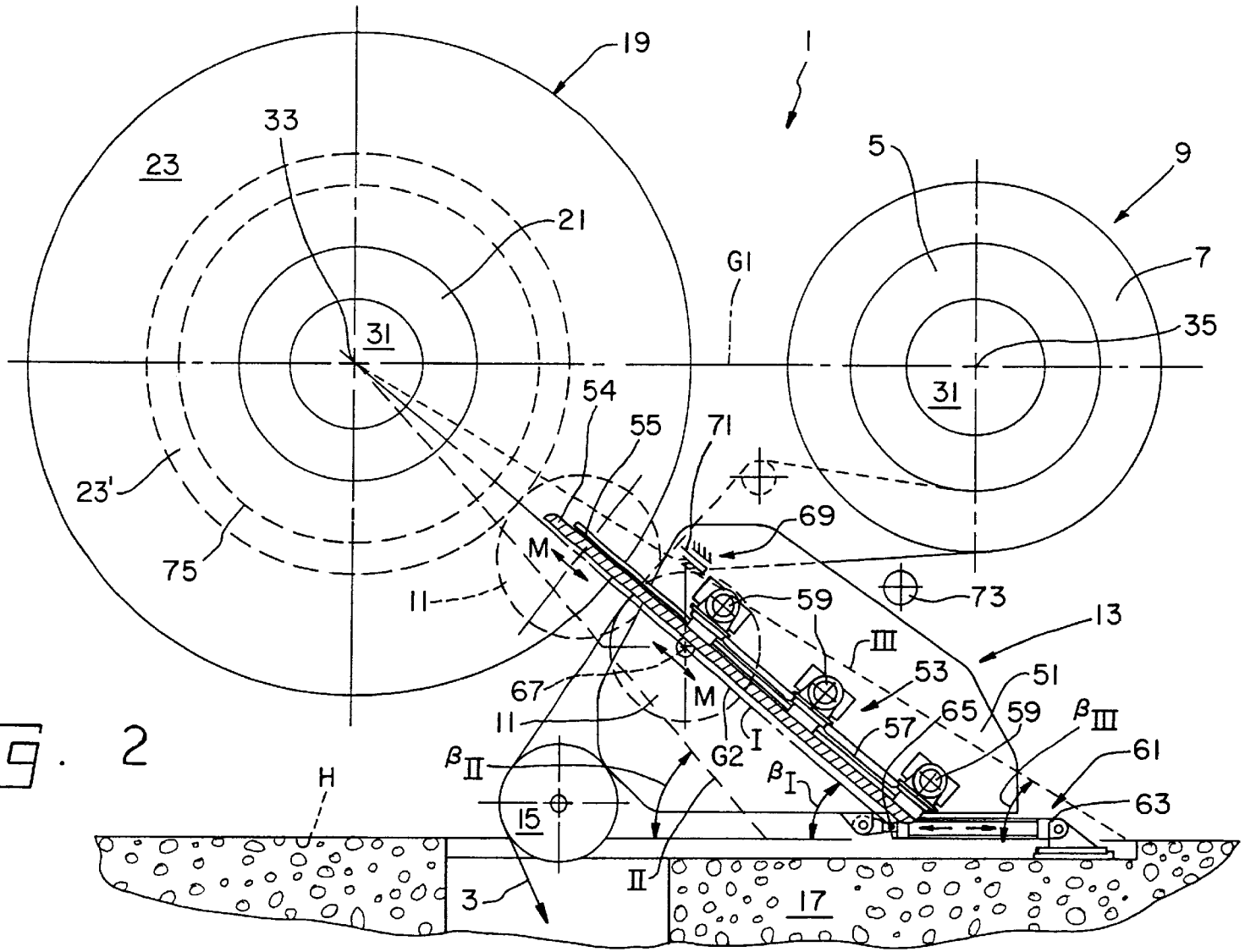
FIG. 2 is a scaled up section of the unwinding station of FIG. 1.

FIG. 2 shows schematically part of the unwinding station 1 of FIG. 1, scaled up, namely the reels 23, 7 and the splicing system 13. Same parts are referenced identically, so that reference may be made to the description relative to FIG. 1. The splicing system 13 of the unwinding station 1 includes a splicing carriage 51 supporting the splicing roll 11. The latter may be formed of metal, notably steel, or a carbon-fiber-reinforced plastic (CFK) and have a diameter of, e.g., 850 mm. The splicing roll 11 can be positioned opposite the splicing carriage 51 by use of a positioning device (not shown), which may be designed, e.g., as a pivoting system. Coordinated with the splicing carriage 51 is a linear guide system 53 featuring two linear guides 55, of which in FIG. 2 only the linear guide 55 arranged on a support bar 54 is visible. Moreover, the linear guide system 53 includes a linear carriage pair 57, i.e., two linear carriages 57, with each arranged on one side of the splicing carriage 51 and joined to it through several bearings 59. Three bearings 59 are shown. Coordinated with the splicing carriage 51 is a drive system 61 fashioned as a piston-cylinder unit including a cylinder 63 hinged to the foundation 17 and a Ram 65 running in the cylinder 63. Ram 65 is joined to the splicing carriage 51 such that the splicing carriage 51 is moved by use of the linear guide system 53 as the ram 65 retracts or deploys. The splicing carriage 51 is equipped with a cutting device 69 which features a serrated cut-off blade 71. Blade 71 is positionable relative to the splicing carriage 51 by use of a positioning device (not shown) arranged on the splicing carriage 51. The positioning device may be configured, e.g., as a pivotal device, so that the cut-off blade 71 is pivotable relative to the splicing carriage 51.

The center of gravity of the splicing carriage 51 carrying the splicing roll 11, with which roll a rotary drive may be coordinated, is disposed exactly vertically below the center of gravity of the splicing roll 11. As a result, the inherent weight of the splicing roll 11 has only a small effect on its movement. The center 67 of the splicing roll 11 is situated on an imaginary second straight line G2, illustrated as dashed, intersecting the center 33 of the reel 23 supported by the primary unwinding system 19. The second straight line G2 at line position I is inclined relative to the foundation 17 at an angle $\beta_1$ of about 40°. In another embodiment of the unwinding station, the second straight line G2 may be inclined relative to the foundation 17 at line positions II and III respectively, at an angle $\beta_{II}$ which is greater or an angle $\beta_{III}$ which is smaller than 40°. That is, the inclination of the second straight line G2 is variable.

Cooperating with the splicing system 13 is a guide roll 73 which, prior to splicing the material webs 3 wound on the reels 7 and 23, can be moved onto the material web 3 unwinding from the reel 7, with web 3 being carried in open draw between the reel 7 and the splicing roll 11. Formed by at least one roll or a tubular shaft, possibly several rolls or tubular shafts, the guide roll 73 is able to pivot to the position shown in FIG. 2 by dashed line. It is also possible to move the guide roll 73 along a straight line. The guide roll 73 may have coordinated with it a drive allowing adjustment of the traction of the material web 3. The cutting device 69 is arranged subsequent to the guide roll 73, viewed in the direction of travel of the material web 3. That is, the cutting device 69 is disposed in the area between the splicing nip formed by the splicing roll 11 and reel 23 and the guide roll 73. To reduce the weight of the splicing carriage 51, so-called shred deflectors may be mounted in stationary fashion in the basement. The deflectors serve to remove or keep away from the material web 3 shreds which have been torn from web 3 in severing it.

The guide roll 73 can be mounted on the splicing carriage 51 in pivotable fashion, so that a compact assembly is formed which includes the splicing roll 11, cutting device 69 and guide roll 73. Another embodiment provides for an installation of the guide roll 73 such that it allows relative positioning with respect to the splicing carriage 51.

Prior to splicing the material webs of the reels 7, 23, the outer layer of the reel 23 is attached to the layer disposed beneath, usually by taping, using a specific adhesive tape. The adhesive tape is configured such that exposed adhesive spots remain on the outside of the reel 23. The material web 3 unwinding from the reel 7 carried by the secondary unwinding system 9 is affixed to the exposed adhesive spots during the splicing process by use of the splicing roll 11. Taking place in the operation of the unwinding station 1 at a traveling speed of the material web up to 2000 m/min or more, the splicing of the material web 3 is also termed "flying splice." This term applies to material webs being spliced while they are moving.

The function of the splicing system 13 during a splicing operation is now described in more detail. To begin with, the material web 3 unwinds from the reel 7 supported by the secondary unwinding system 9 and passes over the splicing roll 11 and the guide roll 15, with guide roll 15 being joined fixedly to the foundation 17. Web 3 then passes on to the converting machine. Before the reel 7 has unwound entirely, the guide roll 73 is pivoted into the open draw of the material web 3 between the reel 7 and the splicing roll 11, deflecting the material web 3. Simultaneously or delayed, the drive system 61 coordinated with the splicing carriage 51 is then actuated. Ram 65 of drive system 61 extends out of the cylinder 63, advancing the splicing carriage 51, by use of the linear guide system 53, directly to the reel 23 supported by the primary unwinding system 19. The reel 23 has meanwhile been accelerated by a drive, such that its peripheral speed substantially matches the speed of the material web 3 unwinding from the reel 7. An electronic control (not shown) recognizes where the prepared splicing point is located on the circumference of the reel 23. As the splicing operation proper is now initiated, which may be effected manually or automatically, the splicing roll 11 is, in time dependence on the revolution of the splice, rapidly forced onto reel 23 by use of the not-illustrated positioning system. Cut-off blade 71 of the cutting device 69 is moved against the material web 3 in the transition area between the guide roll 73 and splicing roll 11, severing web 3 across its entire width. To prevent the tail of the material web 3 unwound from the reel 7 from proceeding into the splicing nip between the splicing roll 11 and reel 23, blowing devices (not shown) are provided which keep the material web end away from the splicing nip. The severed end of the material web 3 is affixed to the material web wound on the reel 23 in the splicing nip. The sticking effect of the adhesive spots on the outside of the reel 23 is greater than that of the adhesive spot joining the outer layer to the one beneath. Hence, the material web wound on the reel 23 is separated by the unwinding traction and unwound.

Once the splicing is completed, the splicing carriage 51 and guide roll 73 restore to their home positions. The drum 5 carried by the secondary unwinding system 9, still containing a remainder of the reel 7, is removed, as indicated in FIG. 1, from the unwinding station 1, e.g., by use of a lifting device. Next, the reel 23, carried so far by the primary unwinding system 19, transfers by use of the carrying system 25 and the transport carriage 32 along the first straight line G1 to the secondary unwinding system 9.

The movement of the splicing roll 11 along the second straight line G2 in linear direction M, as indicated in FIG. 2, ensures that the splicing nip formed between the splicing roll 11 and reel 23 is always disposed always on the second straight line G2, regardless of the diameter of reel 23. This assures that the entrance angle of the material web 3 unwinding from the reel 7 supported by the secondary unwinding system 9 is independent of the diameter of the reel carried by the primary unwinding system 19 and is substantially constant. Identical conditions prevail in each splicing operation, enabling a reproducible splicing of the material webs. The splicing roll 11 can be pressed evenly onto the reel 23, allowing the adjustment of constant line forces in the splicing nip. This makes it possible to guarantee an especially high reliability of the splicing system 13, and thus of the unwinding station 1.

FIG. 2 illustrates the reel 23 with different diameters. The largest diameter of the reel illustrated by solid line may amount, e.g., to 3,500 mm. The splicing roll 11 is shown in a position in which it forms a splicing nip with a reel 23' having a diameter of, e.g., 2,200 mm. Also, the reel 23 is illustrated by dashed line 75 in a position in which the material web has already been unwound down to a diameter of, e.g., about 1,900 mm. With this diameter of the reel 23 carried by the primary unwinding system 19, the reel 23 transfers along the first straight line G1 to the secondary unwinding system 9. The diameter references and conditions deriving thereof are meant to be understood merely as examples.

Especially helpful in transferring the reel along the straight line extending parallel to the horizontal line H is that no forces acting in the direction of the longitudinal expanse of the unwinding station 1 are introduced in the foundation 17, such as occurring in a reel transfer by use of pivoting arms.

Figure 3:
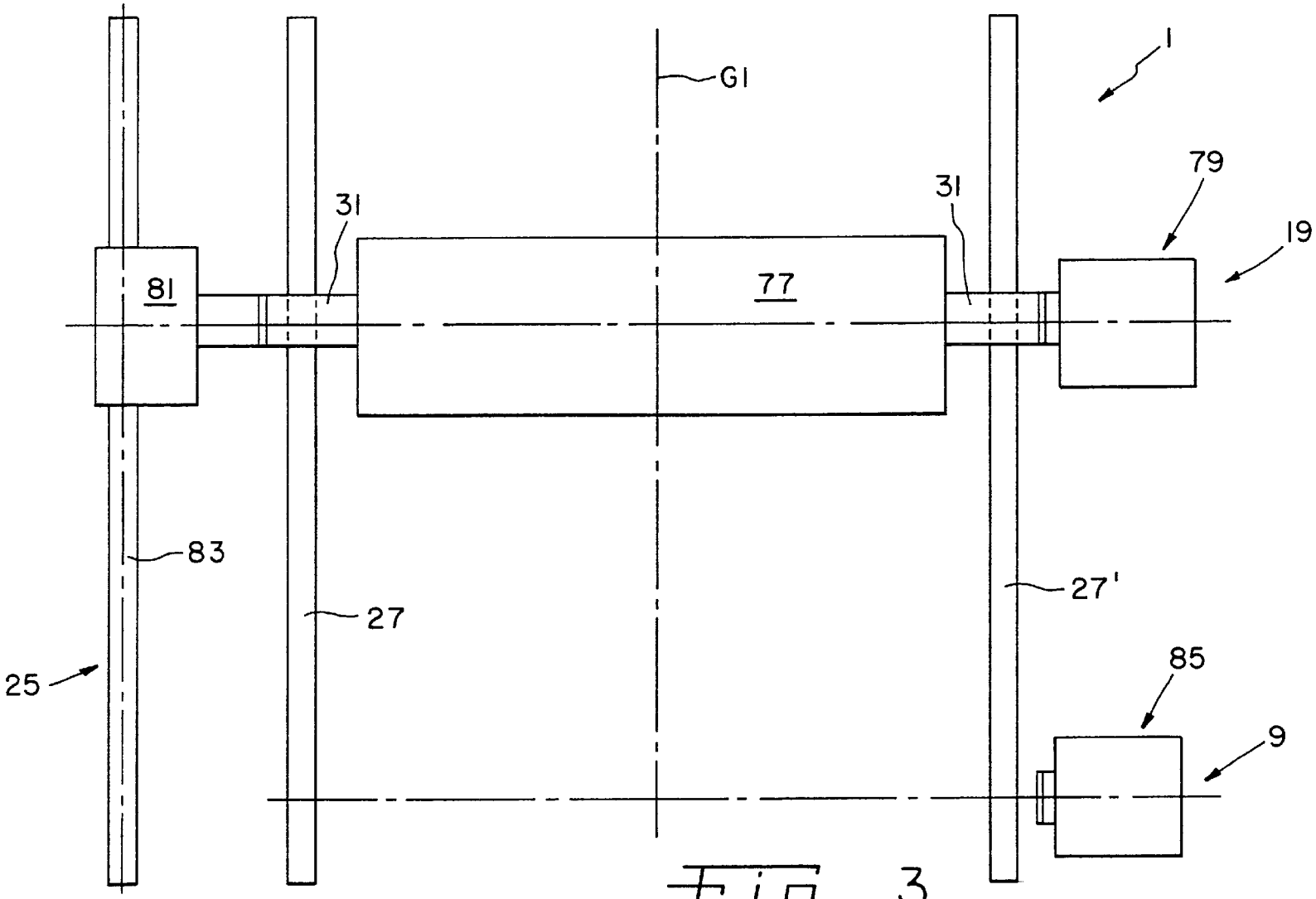
FIG. 3 is a plan view of another embodiment of an unwinding station.

FIG. 3 shows in greatly schematic fashion a plan view of another embodiment of the unwinding station 1. Parts corresponding with those described with the aid of FIGS. 1 and 2 are referenced identically, so that reference can be made to the description of FIGS. 1 and 2. In the operating position of the unwinding station 1 illustrated in FIG. 3, a reel 77 is carried by the primary unwinding system 19. The reel 77 connects via its right-hand journal 31 to a stationary drive 79 of the primary unwinding system 19. In conjunction with the present invention, a "stationary" arrangement is understood as a fixed, invariable position. The drive 79 is mounted on a base 87 resting on the foundation 17 (FIG. 4) and serves to impart a torque to the reel 77, accelerating it to the speed of travel of the material web, not illustrated in FIG. 3, and maintaining it at that speed. Moreover, the primary unwinding system 19 features a braking generator (not shown) by use of which the reel 77 can be slowed down. The braking generator, for example an electric motor, may be installed on a stationary base, similarly to drive 79. When using an electric motor as braking generator, it can also be operated as a motor, depending on the operating situation. For example, the braking generator can be operated as a motor in the start-up of the unwinding station 1 or during the operation of the winding station 1, that is, while the reel 77 is carried by the primary unwinding system 19.

The left-hand journal 31 of the reel 77 is coupled to an auxiliary drive 81 supported by a rail 83. The rail 83 is aligned parallel to the rails 27 and 27' of the carrying system 25, that is, the auxiliary drive 81 is movable parallel to the straight line G1. The auxiliary drive 81 serves to keep the unwinding traction of the material web unwinding from the reel 77 at a desired value, or to adjust it thereto, while the reel 77 transfers from the primary unwinding system 19 to the secondary unwinding system 9 along the straight line G1. The auxiliary drive 81 is coupled to at least one of the transport (secondary) carriages 32, not illustrated in FIG. 3, and transfers jointly with the reel 77 to the secondary unwinding system 9. The drive of the transport carriages 32, as described above, is effected by use of at least one spindle.

As follows from FIG. 3, the secondary unwinding system 9 also includes a stationary drive 85 and a not-illustrated braking generator mounted, e.g., on a stationary base. The drives 79 and 85 can be identical in structure. The stationary drives 79 and 85 are disposed on the drive side of the unwinding station 1. Consequently, the auxiliary drive 81 is arranged on the tending side of the unwinding station 1.

Before the reel 77 transfers to the secondary unwinding system 9, the auxiliary drive 81 is coupled to the reel 77, while the connection of the reel 77 to the drive 79 of the primary unwinding system 19 is interrupted. During its transfer, the reel 77 is driven by the auxiliary drive 81, supported by the rail 83, until the reel 77 has been coupled to the drive 85 of the secondary unwinding system 9 and is powered by it. Furthermore, it is possible for the auxiliary drive 81 to remain coupled to the reel 77 carried by the secondary unwinding system 9 and powered, or braked, by its drive 85, and for auxiliary drive 81 to contribute to the deceleration of the reel 77 by reverse operation.

The respective cooperation of the auxiliary drive 81 with the drives 79, 85 of the primary or secondary unwinding system makes it possible to keep the fluctuations of the material web traction very small. As a result, the so-called splice between two material webs can be passed safely through the converting machines following the unwinding station 1.

All of this shows that the auxiliary drive 81 may be employed while the reel 77 is carried either by the primary unwinding system 19 or the secondary unwinding system 9 and decelerated or driven by drive 79 or drive 85 of the relevant unwinding system. In another embodiment of the unwinding station, two auxiliary drives are provided which are movable parallel to the first straight line G1, making the stationary drives 79, 85 described with the aid of FIG. 3 dispensable. Adapted for mounting on opposite sides of the unwinding station, the auxiliary drives may be employed in a way such that a full reel is driven or decelerated exclusively by one of the two auxiliary drives during the entire unwinding process. Hence, the reel may be driven or decelerated by the auxiliary drive while it is carried by the primary unwinding system 19, transferred from the primary to the secondary unwinding system, and while being carried by the secondary unwinding system. An unwinding station featuring two movable auxiliary drives has a simpler structure than the unwinding station described with the aid of FIG. 3, since the latter requires three drives overall, namely two stationary and one auxiliary drive.

Figure 4:
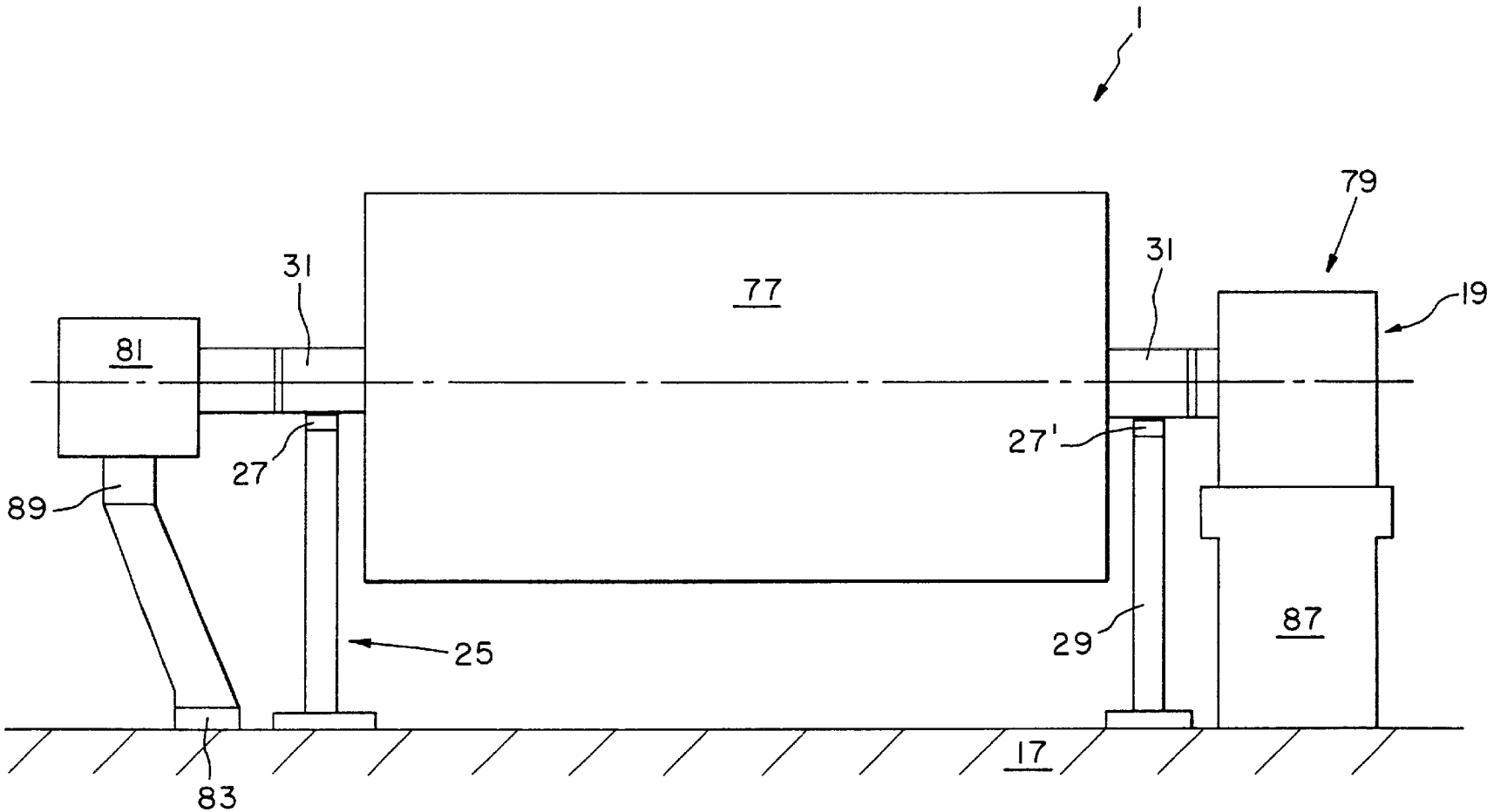
FIG. 4 is a cross section of the unwinding station of FIG. 3.

FIG. 4 shows a cross section of the unwinding station 1 of FIG. 3. The drive 79 is arranged on a base 87, for example of concrete, resting on the foundation 17. Carrying the auxiliary drive 81 or a beam 89 joined to it, the rail 83 is also mounted on the foundation 17. To accomplish a stable and vibration-insensitive mounting of the auxiliary drive 81, the beam 89 features an angled pattern and, due to its contour, is also called "surfer." In another embodiment, the beam has a straight pattern, which also enables a vibration-insensitive and stable mounting of the auxiliary drive 81.

All of this shows that the structure of the unwinding station 1 described with the aid of FIGS. 1 through 4 can be considerably simplified as compared to known unwinding stations. This is made possible by transferring the reel from the primary to the secondary unwinding system, as well as by moving the splicing roll along a straight line. Expensive pivotal arm constructions are dispensable here, also enabling an easy assembly of the unwinding station. Furthermore, the length and height of the unwinding station, and thus its costs can be reduced.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An unwinding station for continuous unwinding of a fiber material web before the fiber web is fed into a machine for processing the fiber web, said unwinding station comprising:

a primary unwinding system carrying a primary reel configured for unwinding a primary fiber material web, said primary reel being movable substantially along a first straight line extending in a substantially horizontal direction;

a secondary unwinding system carrying a secondary reel configured for unwinding a secondary fiber material web;

a splicing system configured for splicing together the unwinding primary fiber material web and the unwinding secondary fiber material web;

a carrying system associated with each of said primary unwinding system and said secondary unwinding system, said carrying system being configured for carrying said primary reel from said primary unwinding system to said secondary unwinding system after said splicing, said carrying system including a set of at least two substantially parallel rails carrying said primary reel in a substantially horizontal direction, said set of at least two substantially parallel rails being disposed at a vertical level;

an auxiliary drive associated and jointly movable with said primary reel, said auxiliary drive driving said primary reel; and a feed system including a set of at least two substantially horizontal support rails aligned and configured for carrying a replacement reel in a primary direction from said feed system to said primary unwinding system, said set of at least two substantially horizontal support rails being disposed at said vertical level such that said set of at least two substantially parallel rails and said set of at least two substantially horizontal support rails are substantially coplanar, said feed system being movable in a secondary direction said secondary direction differing from said primary direction.

2. The unwinding station of claim 1, wherein said carrying system is configured for moving said primary reel along said first straight line, said feed system including a transport carriage configured for moving the replacement reel in a direction substantially transverse to said first straight line.

3. The unwinding station of claim 1, wherein said feed system includes a set of carriage transport rails and a transport carriage movable thereon, said transport carriage having said set of at least two substantially horizontal support rails disposed thereon.

4. The unwinding station of claim 1, further comprising a auxiliary rail carrying said auxiliary drive.

5. The unwinding station of claim 4, wherein said auxiliary rail is oriented substantially parallel to at least two substantially parallel rails of said carrying system.

6. The unwinding station of claim 1, wherein at least one of said primary unwinding system and said secondary unwinding system includes a stationary drive.

7. The unwinding station of claim 1, wherein said splicing system includes at least one splicing roll and a linear guide system, said at least one splicing roll being movable along a second straight line by use of said linear guide system.

8. The unwinding station of claim 7, wherein said second straight line is oriented at an angle relative to said generally horizontal direction.

9. The unwinding station of claim 8, wherein said angle is variable.

10. The unwinding station of claim 7, wherein said at least one splicing roll is drivable.

11. The unwinding station of claim 1, wherein said feed system includes:

at least one foundation rail configured for being attached to a fixed structure, said at least one foundation rail extending in a direction substantially transverse to said at least two substantially horizontal support rails; and a transport carriage slidably attached to said at least one foundation rail and supporting said at least two substantially horizontal support rails.

12. The unwinding station of claim 11, wherein said transport carriage includes a base frame, said pair of substantially horizontal support rails being mounted on said base frame.

13. The unwinding station of claim 1, wherein said at least two substantially horizontal support rails are disposed substantially at a same vertical level as said at least two substantially parallel rails of said carrying system.

* * * * *